United States Patent [19]

Strickland

[11] 4,149,721

[45] Apr. 17, 1979

[54] REPLACEABLE GRIP PIECE FOR RACKET

[76] Inventor: Gordon E. Strickland, 343 Guinda St., Palo Alto, Calif. 94301

[21] Appl. No.: 795,195

[22] Filed: May 9, 1977

[51] Int. Cl.[2] ..... A63B 49/08

[52] U.S. Cl. ..... 273/73 J; 273/75

[58] Field of Search ..... 273/73 R, 73 H, 73 J, 273/75, 76, 81 R, 81 B, 81 D, 81.4, 81.5, 81.6, 81.2, 81.3

[56] References Cited

U.S. PATENT DOCUMENTS

| | | | |
|---|---|---|---|
| 399,340 | 3/1889 | Morgan | 273/75 |
| 1,581,647 | 4/1926 | Layton | 273/75 X |
| 2,328,366 | 8/1943 | Timmermann | 273/75 X |
| 3,203,697 | 8/1965 | Berzatzy | 273/75 |
| 3,501,148 | 3/1970 | Cheris et al. | 273/75 |
| 3,540,728 | 11/1970 | Palmer | 273/73 J |
| 3,674,267 | 7/1972 | Hollis | 273/75 |

FOREIGN PATENT DOCUMENTS

| | | | |
|---|---|---|---|
| 967300 | 3/1950 | France | 273/73 J |
| 409325 | 4/1934 | United Kingdom | 273/81 B |

*Primary Examiner*—Richard J. Apley
*Attorney, Agent, or Firm*—Marshall C. Gregory

[57] ABSTRACT

A racket for tennis and like games which includes a handle having a substantially oval cross-section, with two flat opposite planar surfaces of dimension such that the grasp of the hand on the racket is more accurately aligned to control the orientation of the plane of the head than is the case with existing rackets. The handle may be constructed to receive a rigid hollow grip portion so that the grip portion may be quickly replaceable to change grip size or surface characteristics.

2 Claims, 6 Drawing Figures

REPLACEABLE GRIP PIECE FOR RACKET

BACKGROUND OF THE INVENTION

The present invention relates to a game device, particularly a racket such as is used in tennis, badminton, squash, paddle ball and other similar games employing a racket having a flat hitting portion, normally strung, with an elongated portion terminating in a handle or grip portion. The grip or handle portion which the hand engages is of critical importance to the player in affecting the skill with which he may use the racket. Not only the size and feel of the grip, but the accuracy with which it may facilitate holding the racket in proper orientation to the plane of the stroke are vital to accurate control in hitting the ball, and placing its point of impact where desired in the court.

While similar accuracy of grip registration with the hitting surface is required in other sports or games, e.g., golf, the tennis player not only must shift his grasp on the racket very rapidly for different strokes, he must do so by feel—there is seldom time to look and place the handle in the hand properly by visual reference. Although some players use a grip which is not changed in making either a forehand or backhand stroke, the usual practice for an experienced player requires as many as five different precise grasps on the racket, to position the head precisely for the swing to be used. Thus, one orientation of grasp is required for the forehand, one for the backhand, a shortened version of each for forehand and backhand volleys at the net, and another for serving or overhead smashes (and these latter two grasps may vary for some players).

To exemplify the required accuracy of registration of the grasp with the orientation of the racket face, on a low flat drive from the baseline, wherein it is desirable to achieve a low trajectory with considerable velocity on which the ball should clear the net by about three inches, an error or misalignment of grasp wherein the surface of the handle is rotated in the hand about 2 degrees (or only about 1/32nd inch on the surface of the grip portion) can result in the ball hitting the net 18 to 20 inches below the top, or to clear it by almost that same distance (all other factors assumed constant) and consequently falling outside the playing surface of the court.

In past years devices or structures have been proposed or constructed with the intent of facilitating greater accuracy of registration of the position of the handle within the hand. U.S. Pat. No. 259,448, issued in 1882, proposed a handle with three bulges for positioning the hand. Much more recently U.S. letters patent have issued for an attachment to be externally mounted for positioning the thumb (No. 3,817,521) and for a contoured grip (No. 3,905,589). These additions of auxiliary devices, however, have not changed the basic standard shape of the handle of the racket, which has remained substantially square in cross-section, with the corners bevelled to allow for easier gripping. The resultant shape is an irregular octagon, and it is at best difficult to ensure proper orientation of the racket head with only a single hand grasp of the handle.

SUMMARY OF THE INVENTION

In view of the foregoing factors it is a primary object of this invention to provide a new design for the shape of the tennis racket handle itself, so that the racket may be more accurately oriented by the feel of its grip alone, and thus to achieve a more precise alignment of the natural plane sensed by the grasp of the hand and the actual plane of the racket head or face.

It is a further object of the invention to provide a more satisfactory grip in that the flat surfaces against which the palm of the hand (for the forehand) or the thumb (for the backhand) may exert pressure in the swing are half again as wide as those provided by standard handles, thus affording greater accuracy of control and facilitating more natural application of force. These larger flat surfaces additionally make the grasp on the racket more secure, and their relation to the arcuate surfaces conforms more naturally to the bending pattern of the phalangeal bones of the fingers.

The shape further facilitates the very rapid changes of grasp of the hand on the racket required by the game. Its more distinctive feel provides a very rapid sensory signal, in that the intersections of the flat surfaces and the arcuate surfaces create distinct edges, palpable to the hand, which serve to immediately orient the racket in the hand. The grasp of the hand may be changed in one or more ways: (1) the grasp is loosened, and the handle rotated by pressure or impulse from the thumb or fingers, (2) the grasp is loosened sufficiently so that the handle is floating free and the hand rapidly shifted to a new relationship, or (3) the grasp is loosened and the handle rotated by the other hand (this last method being especially adapted to a two-handed grip). The shape of the new design being more distinctive to the feel, it provides for more rapid recognition of orientation without need for visual verification.

A further object of this invention, in its preferred embodiment, is the capability to very rapidly change the removable grip portion, to quickly change size or surface characteristics, or replace a worn grip with a fresh one.

DESCRIPTION OF THE PREFERRED EMBODIMENT

Figure 1:
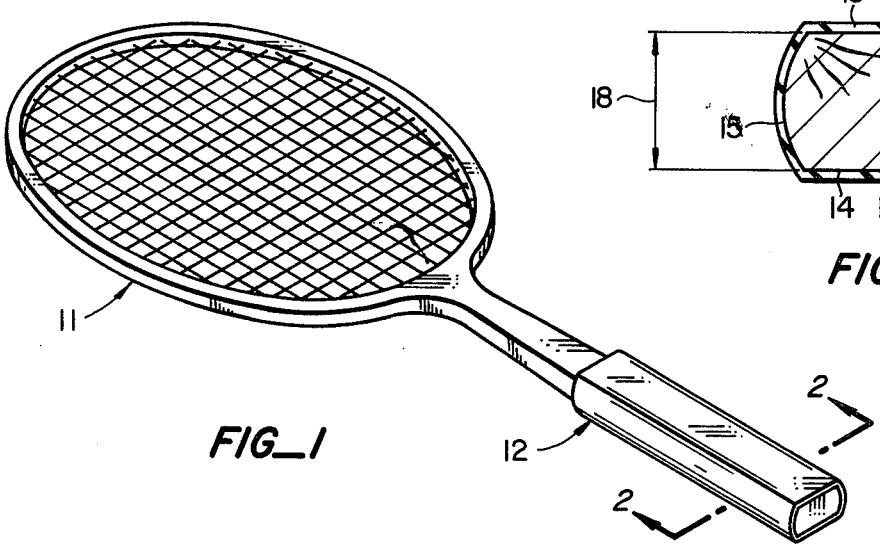
FIG. 1 is a perspective view of a tennis racket embodying the handle shape of the present invention.

Referring in more detail to the figures, FIG. 1 shows generally a tennis racket, with 11 designating the racket frame, with handle or grip portion 12, here shown as wood of the desired cross-sectional shape, with a resilient covering sleeve 13 of rubber-like material. The flat opposite planar parallel surfaces 14 are connected by arcuate surfaces 15.

Figure 2:
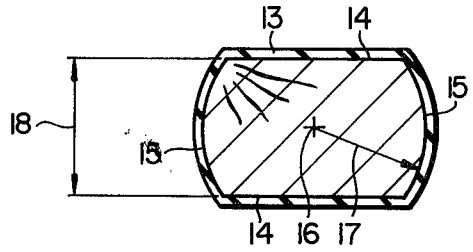
FIG. 2 is a sectional view on line 2—2 of FIG. 1, showing the shape of the handle.

FIG. 2 shows the relationship of the surfaces 14 and 15 to the center of symmetry 16. Ideally, the perimeter of the racket handle (the periphery of the figure in FIG. 2) should be approximately $4\frac{1}{2}$ inches, at which size the handle may be comfortably encircled by a loop made by touching the tips of the thumb and index finger. To achieve this size, the arcuate surfaces 15 are formed as portions of a cylinder of radius 17 (here $\frac{3}{4}$ inch). The width of each flat surface 14 is approximately $1\frac{1}{4}$ inches, with the distance 18 between them being approximately 15/16 inch. The central angle at the center of symmetry 16 subtended by each flat planar surface 14 is greater than 90° (about 110°), while the central angle subtended by each arcuate surface is less than 90° (about 70°). The intersections of the flat parallel planar surfaces 14 and the arcuate surfaces 15 create distinct edges, palpable to the hand in grasping the racket.

Figure 3:
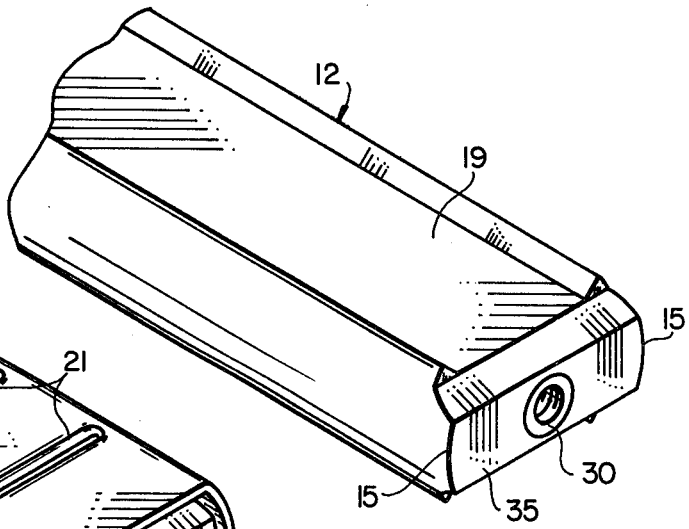
FIG. 3 is a perspective view of the basic handle in its preferred embodiment, showing a channel which slidably receives positioning ribs of a hollow grip portion which fits over the handle, and bolt accepting means for securing said hollow grip portion to said handle.
Figure 4:
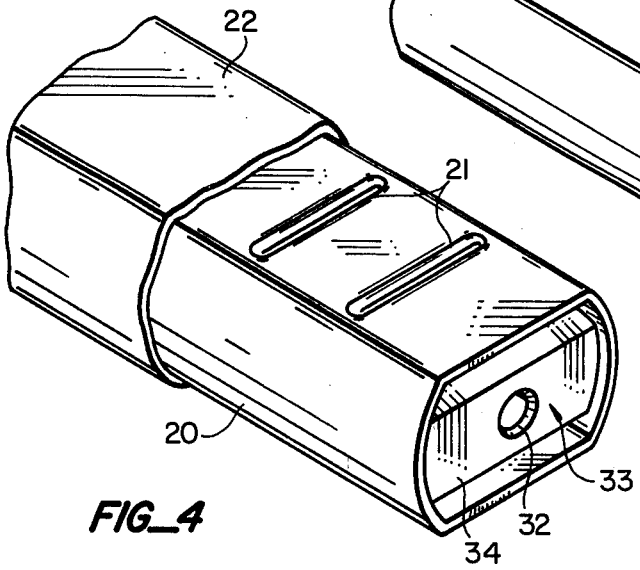
FIG. 4 is a perspective view of the hollow grip portion which forms the hand-engaging portion of the preferred embodiment of the invention.

In the preferred embodiment, the handle 12 has chamfered or formed therein at least one channel 19, as shown in FIG. 3. FIG. 4 shows a hollow grip portion 20, formed of light but rigid material, preferably of seamless aluminum of thickness no greater than 0.050 inch, conforming exactly in shape to handle 12 to fit thereon. Positioning ribs or projections 21 projecting interiorly in grip portion 20 are slidably and precisely received by channel 19 to prevent any rotational movement of grip 20 when in place, and to further strengthen said grip 20 and assure that surfaces 14 are precisely flat.

Figure 5A:
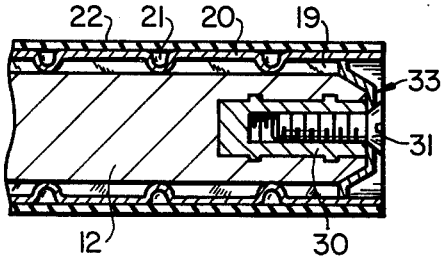
FIGS. 5*a* and 5*b* are sectional views showing the base locking means for securing the hollow grip portion to the basic handle.
Figure 5B:
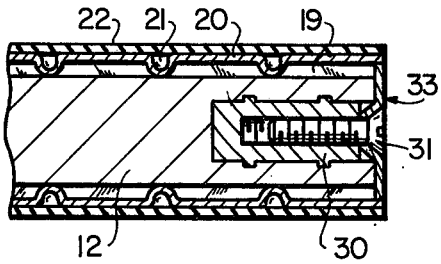

Grip portion 20 is secured in place by suitable fastening means such as machine screw or bolt 31 (FIGS. 5), which passes through fitting 32 on end cap 33 of said hollow grip portion 20 and engages bolt accepting means 30 affixed into the center of handle 12, as shown in FIGS. 3, 4, 5*a* and 5*b*. Grip 20 is even more securely locked to handle 12 by a groove 34 and cooperating bar 35 which fits precisely and snugly therein. In FIGS. 3, 4 and 5*a* is shown a configuration wherein a bar of substantially trapezoidal cross-section is formed on the end of handle 12, with end cap 33 shaped so that the sloped shoulders and flat center surface are precisely engaged. Depending on the materials used for handle 12 and grip 20, an optional configuration is shown in FIG. 5*b*, wherein smooth end cap 33 has formed thereon a V-shaped bar, projecting into and precisely engaging a V-shaped groove on handle 12.

By expanding the size of hollow grip portion 20, and correspondingly increasing the interior depth of projection or projections 21, so that they still precisely engage channel 19, the outside perimetric measurement of the hand-engaging surface of grip portion 20 can be made larger, so that a set of interchangeable grip portions of differing sizes can be made available for the same basic handle supporting structure.

The outside surface of hollow grip portion 20 will have applied to it one or another standard resilient handle covering to provide a smooth but non-slip hand-engaging surface.

I claim:

1. A racket for tennis and like games, comprising a head portion and a handle portion, there being in at least one surface of said handle portion a channel beginning at the exposed end and moving substantially longitudinally along said handle, and further including a hollow grip portion formed of rigid material conforming exactly in shape with and fitting closely and precisely over said handle portion, said hollow grip portion presenting a smooth but resilient and non-slip surface to provide an integral and complete hand-engaging surface for the racket, said hollow grip portion further including at least one projection on at least one interior surface of said hollow grip portion, said projection being slidably and precisely received by said channel in said handle to permit said hollow grip portion to be snugly and fixedly attached to and to be removable from said handle.

2. A racket according to claim 1, further including base locking means, on said exposed end of said handle, operatively associated with and precisely engaged by cooperating means on said hollow grip portion, for rendering said hollow grip portion fixed with relation to said handle portion, the base locking means being associated with base attaching means adapted to facilitate quick removal and replacement of said hollow grip portion.

* * * * *